US006693787B2

(12) United States Patent
Kolmanovsky et al.

(10) Patent No.: US 6,693,787 B2
(45) Date of Patent: Feb. 17, 2004

(54) CONTROL ALGORITHM FOR SOFT-LANDING IN ELECTROMECHANICAL ACTUATORS

(75) Inventors: Ilya V. Kolmanovsky, Ypsilanti, MI (US); Mohammad Haghgooie, Superior Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 173 days.

(21) Appl. No.: 10/098,780

(22) Filed: Mar. 14, 2002

(65) Prior Publication Data

US 2003/0184946 A1 Oct. 2, 2003

(51) Int. Cl.[7] ..... H01H 9/00
(52) U.S. Cl. ..... 361/160; 361/154; 361/187
(58) Field of Search ..... 361/152, 154, 361/160, 153, 187, 139, 155, 156, 166

(56) References Cited

U.S. PATENT DOCUMENTS

| | | | | |
|---|---|---|---|---|
| 5,703,748 A | 12/1997 | Fulks et al. | ..... | 361/153 |
| 5,905,625 A | 5/1999 | Schebitz | ..... | 361/154 |
| 5,917,692 A | 6/1999 | Schmitz et al. | ..... | 361/187 |
| 5,959,825 A | 9/1999 | Harcombe | ..... | 361/154 |
| 6,128,175 A | 10/2000 | Wright et al. | ..... | 361/154 |
| 6,141,201 A | 10/2000 | Schmitz | ..... | 361/154 |
| 6,158,403 A | 12/2000 | Berecewicz et al. | ..... | 123/90.11 |
| 6,158,715 A | 12/2000 | Kirschbaum | ..... | 251/129.06 |
| 6,176,207 B1 | 1/2001 | Wright et al. | ..... | 123/90.11 |

FOREIGN PATENT DOCUMENTS

WO WO 91/08384 6/1991

OTHER PUBLICATIONS

Butzmann, S., "Sensorless Control of Electromagnetic Actuators for Variable Valve Train" 2000–01–1225 Society of Automotive Engineers, Inc. (2000).
Rouge, Thierry, "Electromagnetic Valve Actuation 'SVA'," SAE Variable Valve Actuation TOPTEC®: The State of the Art, Sep. 11–12, 2000.

*Primary Examiner*—Anthony Dinkins

(57) ABSTRACT

A system (12) and method for controlling an armature (20) of an electromagnetic actuator (10) are provided. The system (12) includes a circuit (46) for providing current to the coils (32, 34) of electromagnets (16, 18) disposed on either side of the armature (20). The system (12) also includes an electronic control unit (ECU) (50). The ECU (50) is configured to determine the neutral position of a virtual spring corresponding to the combination of forces acting on the armature 20 including the magnetic force of the attracting electromagnet (16 or 18) and the force of a restoring spring (22 or 24) opposing movement of the armature (20) towards the attracting electromagnet (16 or 18). The ECU (50) is further configured to control the current in the coil (32 or 34) of the attracting electromagnet (16 or 18) responsive to the determined neutral position so as to minimize the velocity of the armature as it reaches the pole face (36 or 38) of the attracting electromagnet (16 or 18).

28 Claims, 3 Drawing Sheets

CONTROL ALGORITHM FOR SOFT-LANDING IN ELECTROMECHANICAL ACTUATORS

FIELD OF THE INVENTION

This invention relates to systems and methods for control of electromechanical actuators and, in particular, to a system and method for controlling the impact or landing of an armature of the actuator against the pole face of an electromagnet of the armature.

BACKGROUND OF THE INVENTION

Electromechanical actuators are used in a variety of locations within conventional vehicle engines to control various engine operations. For example, fuel injectors and camless engine valves often include such actuators. A typical two-position electromagnetic actuator includes an armature disposed between a pair of opposed electromagnets. Springs on either side of the armature locate the armature in a neutral position between the electromagnets when the electromagnets are not energized.

To initiate movement of the actuator between the electromagnets, current in the holding electromagnet is switched off. The force of the compressed spring causes the armature to move toward the aforementioned neutral position. At a certain point, the other electromagnet is energized to attract the armature. The magnetic force of attraction between the armature and electromagnet is inversely proportional to the square of the distance between the armature and the electromagnet. Accordingly, the magnetic attraction force increases faster than the linearly increasing force of the opposing spring. As a result, the armature may attain an undesirably high speed as it approaches and lands on the pole face of the electromagnet. This results in undue wear on the mechanical components of the actuator as well as undesirable acoustic noise.

A variety of methods and systems have been developed to control or otherwise limit the speed of the armature as it approaches the pole face of the electromagnet. Conventional methods and systems, however, are relatively complex-requiring extensive measurements or complex calculations to control the armature. Further, conventional systems and methods are often unable to account for unknown disturbances acting on the armature such as gas pressures and eddy currents in the release electromagnet.

The inventors herein have recognized a need for a system and method for controlling movement of an armature towards a pole face of an electromagnet in an electromagnetic actuator that will minimize and/or eliminate one or more of the above-identified deficiencies.

SUMMARY OF THE INVENTION

The present invention provides a system and a method for controlling movement of an armature towards a pole face of an electromagnet in an electromagnetic actuator in which the armature moves toward the pole face against a force of a restoring spring when a coil of the electromagnet is charged with a current. A method in accordance with the present invention includes the step of providing the current to the coil of the electromagnet. The method also includes the step of determining a neutral position for a virtual spring after the armature reaches a predetermined position. The virtual spring has a virtual spring force corresponding to a combination of a magnetic force generated by the electromagnet responsive to the current and a restoring spring force generated by the restoring spring. The method finally includes the step of controlling the current responsive to the neutral position of the virtual spring.

A system in accordance with the present invention includes means for providing current to the coil of the electromagnet and an electronic control unit. The electronic control unit is configured to determine a neutral position for the virtual spring after the armature reaches a predetermined position and to control the current responsive to the neutral position of the virtual spring.

The present invention represents an improvement as compared to conventional systems and methods for controlling movement of an armature towards a pole face of an electromagnet against a restoring spring. In particular, the inventive system and method accurately and efficiently control the velocity of the armature as it approaches the pole face of the electromagnet thereby reducing the impact velocity of the armature. As a result, wear on the mechanical components of the actuator is minimized and acoustic noise significantly reduced. Further, the inventive method and system are robust relative to unknown disturbance forces such as viscous damping that act on the armature as long as the disturbance forces are dissipating. Finally, the inventive method and system are not as complex as conventional methods and systems.

These and other advantages of this invention will become apparent to one skilled in the art from the following detailed description and the accompanying drawings illustrating features of this invention by way of example.

DETAILED DESCRIPTION OF THE PREFERRED EMBODIMENT

Figure 1:
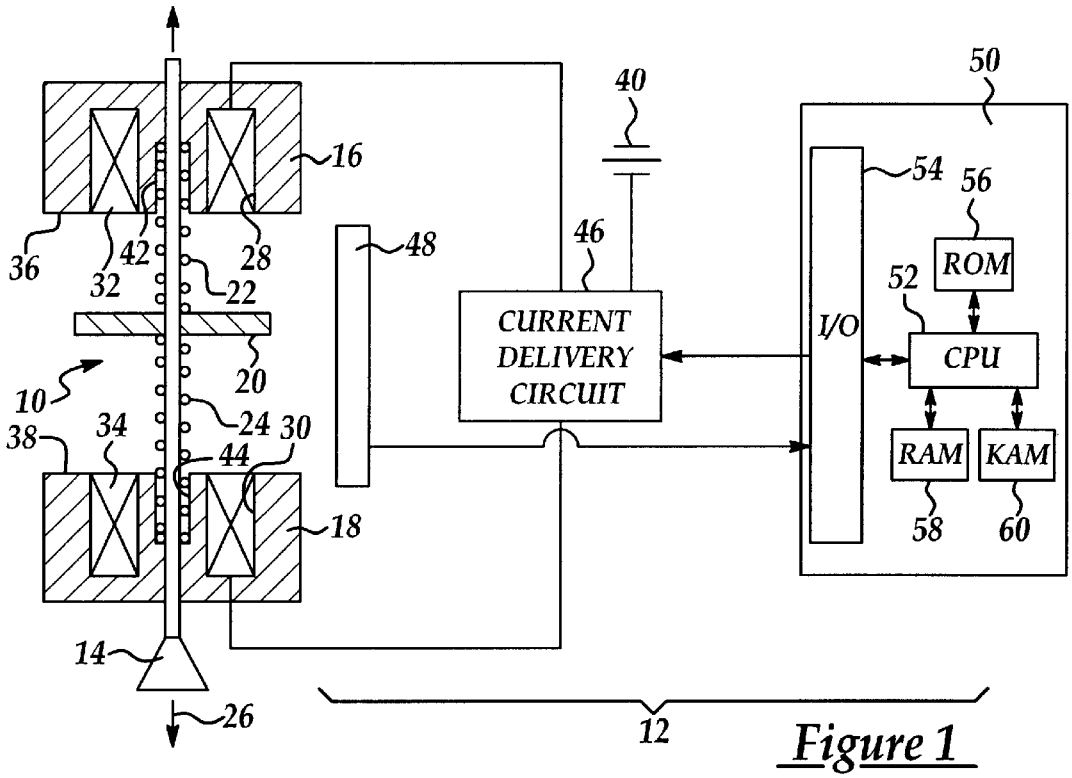
FIG. 1 is a schematic diagram illustrating an electromagnetic actuator and a system for controlling movement of an armature of the actuator in accordance with the present invention.

Referring now to the drawings wherein like reference numerals are used to identify identical components in the various views, FIG. 1 illustrates an electromagnetic actuator 10 and a system 12 in accordance with the present invention for controlling actuator 10. In the illustrated embodiment, actuator 10 is used to control an intake valve 14 in a camless internal combustion engine (not shown). It should be understood, however, that the present invention can be used to control electromagnetic actuators used in a wide variety of vehicular applications such as the intake and exhaust valves, fuel injectors, etc. It should also be understood that the present invention may find use in the control of electromagnetic actuators used in non-vehicular applications.

Actuator 10 is provided to control the position of intake valve 14 and is conventional in the art. Actuator 10 may include electromagnets 16, 18, an armature 20, and springs 22, 24.

Electromagnets 16, 18 are provided to urge armature 20 to move in one of two opposite directions along an axis 26. Electromagnets 16, 18 are conventional in the art and are made of metal, metal alloys, or other conventional materials having a relatively low magnetic reluctance. In the illustrated embodiment, each electromagnet 16, 18 is generally E-shaped in cross-section, defining radially outer annular cavities 28, 30 configured to receive coils 32, 34, respectively. Electromagnets 16, 18 also define pole faces 36, 38, respectively, facing armature 20. Coils 32, 34 are provided to induce a magnetic field in electromagnets 16, 18 and are conventional in the art. Coils 32, 34 receive current from a current source 40 responsive to one or more control signals generated by system 12 as described in greater detail hereinbelow.

Armature 20 is provided to move intake valve 14 and is also conventional in the art. Armature 20 is made of conventional metals or metal alloys or other conventional materials having a relatively low magnetic reluctance. Armature 20 is disposed about intake valve 14 and may be coupled thereto in any of a variety of ways known to those of ordinary skill in the art (e.g., using snap rings, by welding, using an adhesive, etc.). In the illustrated embodiment, armature 20 has a uniform shape and a uniform thickness in cross-section. It should be understood, however, that the size, shape, and configuration of armature 20 may be varied without departing from the spirit of the present invention.

Springs 22, 24 provide a means for biasing armature 20 away from the pole faces 36, 38 of electromagnets 16, 18 and restoring armature 20 to a neutral position between electromagnets 16, 18. Springs 22, 24 are conventional in the art and may be made from conventional materials. In the illustrated embodiment, springs 22, 24 comprise coil springs. Those of skill in the art will understand, however, that the type of springs used may vary. Springs 22, 24 are disposed about intake valve and one end of each spring 22, 24, may be received in a closed bore 42, 44, respectively defined in a corresponding electromagnet 16, 18. An opposite end of each spring 24, 24 is disposed against one side of armature 20.

System 12 is provided to control movement of armature 20 toward pole faces 36, 38 of electromagnets 16, 18 in actuator 10. System 12 may form part of a larger system for controlling operation of an internal combustion engine and components thereof. System 12 may include means, such as current delivery circuit 46, for providing current to coils 32, 34, an armature position sensor 48 and an electronic control unit (ECU) 50.

Circuit 46 selectively provides current to coils 32, 34 from a conventional current source 40 responsive to control signals generated by ECU 50. Circuit 46 may include one or more conventional electronic components (e.g., circuit 46 may simply include a pair of switches disposed in a current flow path between current source 40 and coils 32, 34) and the design of circuit 46 is within the ordinary skill of those in the art.

Armature position sensor 48 is provided to generate a position signal indicative of the position of armature 20 along axis 26 between electromagnets 16, 18. Sensor 48 is conventional in the art and may comprise, for example, a Hall effect sensor, an eddy current linear variable differential transformer (LVDT) sensor, or giant magnetic resonance (GMR) sensor.

ECU 50 is provided to control actuator 20. ECU 50 may comprise a programmable microprocessor or microcontroller or may comprise an application specific integrated circuit (ASIC). ECU may include a central processing unit (CPU) 52 and an input/output (I/O) interface 54. Through interface 54, ECU 50 may receive a plurality of input signals including signals generated by sensor 48 and other sensors (not shown). Also through interface 54, ECU 50 may generate a plurality of output signals including one or more signals used to control current delivery circuit 46. ECU 50 may also include one or more memories including, for example, Read Only Memory (ROM) 56, Random Access Memory (RAM) 58, and a Keep Alive Memory (KAM) 60 to retain information when the ignition key is turned off in a vehicle.

Figure 2:
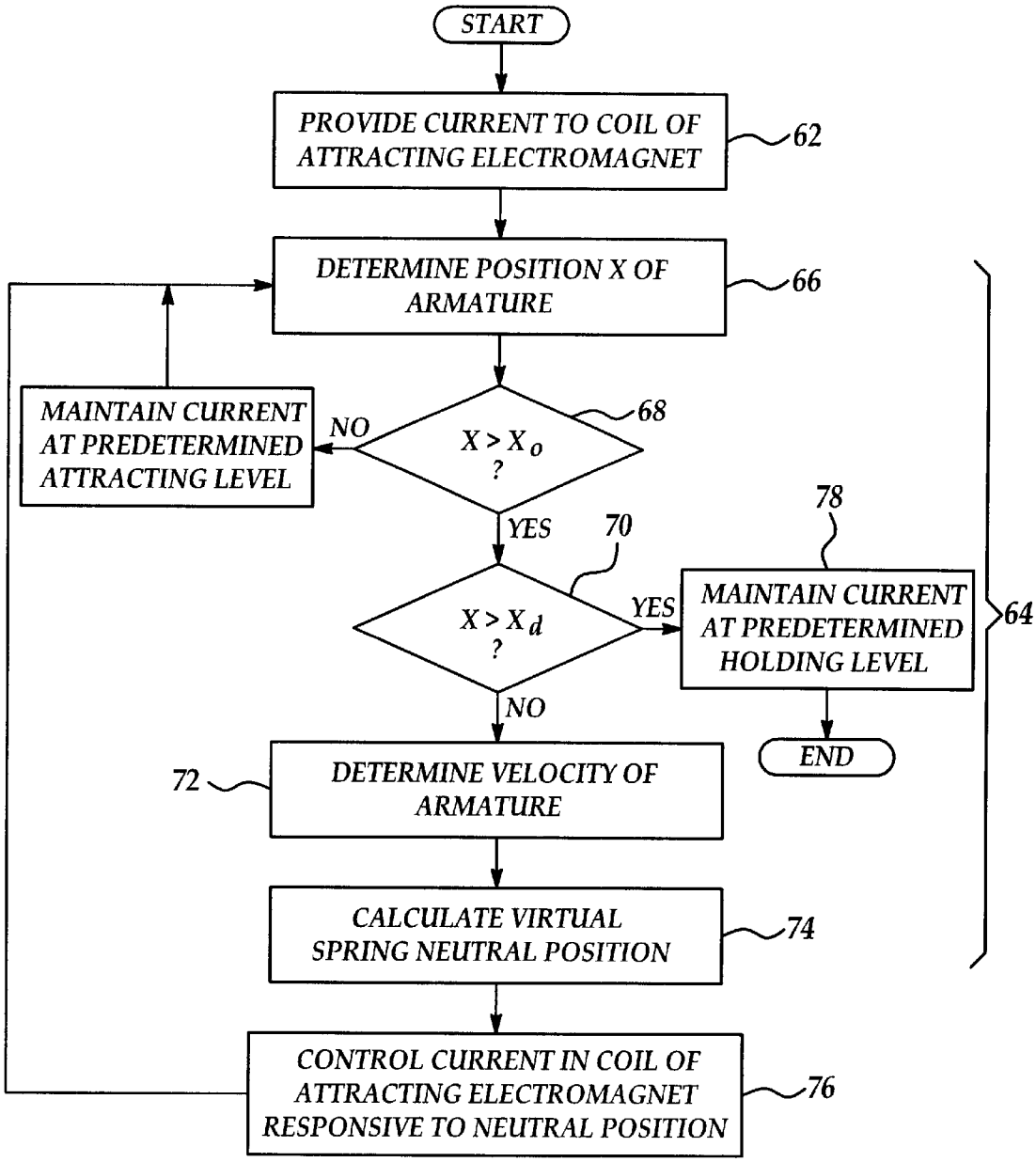
FIG. 2 is a flow chart diagram illustrating a method for controlling movement of an armature in an electromagnetic actuator in accordance with the present invention.

Referring now to FIG. 2, one embodiment of a method for controlling movement of armature 20 toward pole faces 36, 38 of electromagnets 16, 18 in actuator 10 will be described. The description will be written with reference to movement of armature 20 towards pole face 38 of electromagnet 18 as the attracting electromagnet. It should be understood, however, that the description will be applicable to movement of armature 20 in the other direction. The method or algorithm may be implemented by system 12 wherein ECU 50 is configured to perform several steps of the method by programming instruction or code (i.e., software). The instructions may be encoded on a computer storage medium such as a conventional diskette or CD-ROM and may be copied into memory of ECU 50 using conventional computing devices and methods. It should be understood that FIG. 2 represents only one embodiment of the inventive method. Accordingly, the particular steps and substeps illustrated are not intended to be limiting in nature. The method may be implemented using steps and substeps that are different in substance and number from those illustrated in FIG. 2.

Figure 3:
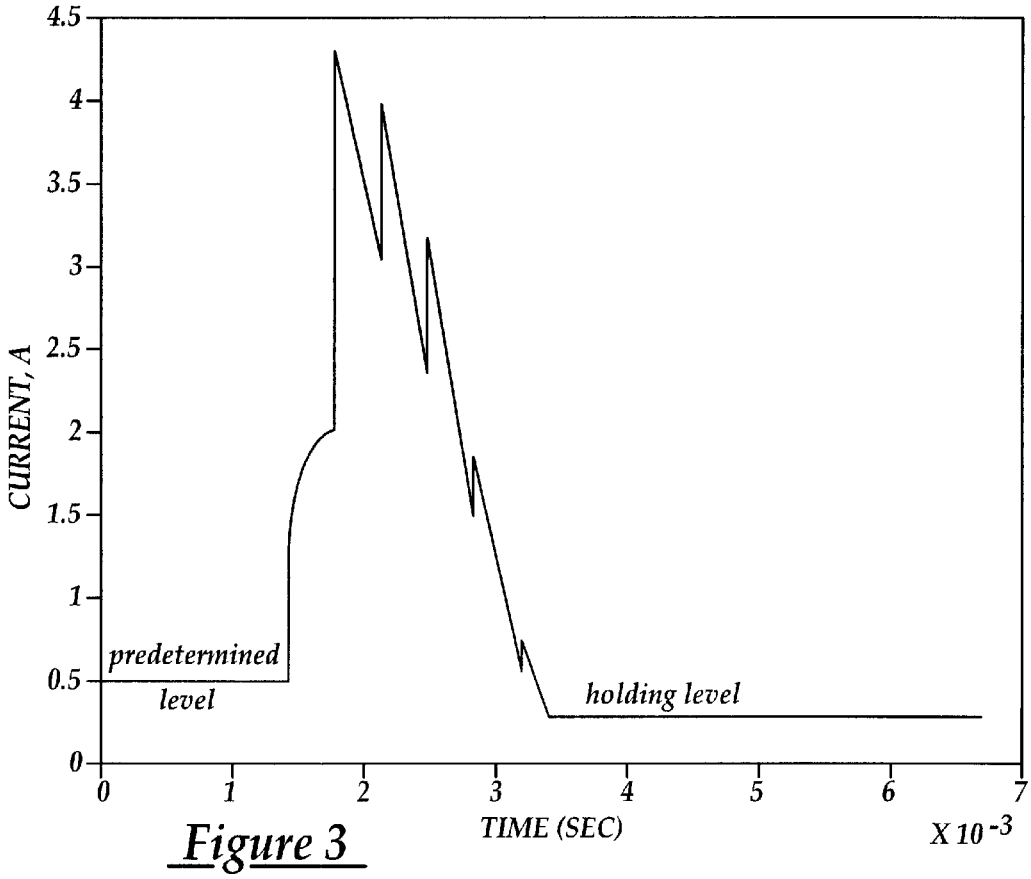
FIG. 3 is a graph illustrating the level of current in an electromagnet coil of the actuator of FIG. 1 over time during movement of the armature towards the electromagnet in accordance with the inventive system and method.

A method in accordance with the present invention may begin with the step 62 of providing current to coil 34 of electromagnet 18. Referring to FIG. 1, ECU 50 may generate a control signal that is provided to circuit 46 to cause current to flow from current source 40 to coil 34. The current flowing in coil 34 creates a magnetic force of attraction in electromagnet 18 drawing armature 20 towards pole face 38 of electromagnet 18. Referring to FIG. 3, this attracting current provided to coil 34 may initially be held relatively constant at a predetermined level.

Referring again to FIG. 2, the inventive method may continue with the step 64 of determining a neutral position for a virtual spring after armature 20 reaches a predetermined position relative to electromagnet 18. As set forth hereinabove, armature 20 itself has a neutral position between electromagnets 16, 18 resulting from the opposed forces generated by springs 22, 24. The virtual spring approximates a combination of the opposed forces acting on armature 20 after armature 20 passes the neutral position—the magnetic force generated by electromagnet 18 responsive to the current in coil 34 and the restoring spring force generated by restoring spring 24 opposing movement of armature 20. The virtual spring has its own neutral position where the opposed forces are approximately equal. The combination of the magnetic and spring forces comprises a virtual spring force. As set forth hereinbelow, the current in coil 34 is controlled to modulate the magnetic force so that the sum of the magnetic force and the spring force is equivalent to a virtual spring force with the same stiffness as spring 24, but a different neutral position.

Step 64 may include several substeps. In particular step 64 may include the substep 66 of determining the position of armature 20. Referring to FIG. 1, ECU 50 may determine the position of armature 20 responsive to a position indicative signal generated by position sensor 48. Step 64 may further include the substep 68 of comparing the sensed position of armature to a predetermined position $x_o$. The predetermined position $x_o$ along with a desired landing or near-landing position $x_d$ establish a restricted positional range during which current to coil 34 is controlled responsive to the virtual spring neutral position. If the comparison indicates that armature 20 has not yet reached the predetermined position $x_o$, current may be maintained at the previously established level and the condition may be reevaluated.

If the comparison in substep 68 indicates that armature 20 has reached the predetermined position $x_o$, step 64 may continue with the substep 70 of determining whether armature 20 has reached the desired position $x_d$. If armature 20 has not yet reached the desired position $x_d$, step 64 may continue with the substep 72 of determining a velocity of armature 20. The velocity of armature 20 can be determined in a number of conventional ways known to those of skill in the art. For example, the velocity of armature 20 may be determined by comparing a pair of armature positions as indicated by position sensor 48 over a predetermined period of time.

Step 64 may continue with the substep 74 of calculating the neutral position of the virtual spring. Actuator 10 has a virtual energy comprising the sum of the energy of the virtual spring relative to its neutral position and the kinetic energy of armature 20. Accordingly, the virtual energy of actuator 10 at a sampling time nT may be represented as follows:

$$E(nT) = \frac{k}{2}(x(nT) - x_v(nT))^2 + \frac{m}{2}v_a(nT)^2$$

where k represents a spring constant associated with both the virtual spring and spring 24 (or the stiffness of the virtual spring and spring 24), x(nT) represents the position of armature, $x_v$(nT) represents the neutral position of the virtual spring, m represents the mass of armature, $v_a$(nT) represents the velocity of armature, and T represents a period of time over which the neutral position of the virtual spring is held constant. As discussed hereinabove, it is desirable to minimize and/or reduce the velocity of armature 20 as it engages pole face 38 of the attracting electromagnet 18. Accordingly, it is desirable to limit the velocity to a predetermined threshold $v_{max}$ at the desired landing or near-landing position $x_d$. Because the virtual spring energy does not increase as long as the neutral position of the virtual spring $x_v$ is held constant, the following inequality may be used to ensure that the velocity $v_a$ of armature 20 is less than $v_{max}$ when armature 20 reaches position $x_d$:

$$E(nT) \geq \frac{k}{2}(x_d - x_v(nT))^2 + \frac{m}{2}(v_{\max})^2$$

This inequality holds true because unmeasured disturbances that may be acting on the armature 20 (e.g., gas pressures, eddy currents in the releasing electromagnet, cycle to cycle combustion volatility) have significantly abated by the time armature 20 reaches the predetermined position $x_o$.

The neutral position $x_v$ of the virtual spring should be advanced towards or even past position $x_d$ as far as possible subject to the above inequality constraint which defines a predetermined range to which the neutral position is restricted. Accordingly the neutral position $x_v$ of the virtual spring may be calculated as follows:

$$x_v(nT) = \left(\frac{m}{2k}\right) * \frac{v_{\max}^2 - v_a(nT)^2}{x_d - x(nT)} + \frac{x_d + x(nT)}{k}$$

wherein the neutral position $x_v$ of the virtual spring is responsive to the mass m of armature 20, a spring constant k associated with restoring spring 24, the velocity $v_a$ of armature 20, the desired position $x_d$ of armature 20, and the predetermined threshold velocity $v_{max}$ of armature 20 at the desired position $x_d$.

The above calculation for obtaining the neutral position $x_v$ of the virtual spring may be further modified to account for additional energies present in the actuator and system 12. For example, one known algorithm for controlling electromagnetic actuators includes an outer control loop that determines a demand for magnetic force by the attracting electromagnet and an inner control loop that determines the current to be provided to the electromagnet's coil to create the demanded magnetic force. See Melbert et al., "Sensorless Control of Electromagnetic Actuators for Variable Valve Train," Society of Automotive Engineers 2000-01-1225 (copyright 2000), the entire disclosure of which is incorporated herein by reference. In this type of control algorithm, the virtual energy derived from the inner control loop could be taken into account in determining the energy of the actuator and system as follows:

$$E(nT) = \frac{k}{2}(x(nT) - x_v(nT))^2 + \frac{m}{2}v_a(nT)^2 + \frac{L}{2}(i - i_o(x_v))^2$$

where L is a constant, i represents the current and $i_o(x_v)$ represents an equilibrium current designed to maintain the position of armature 20 when the virtual spring is at the neutral position $x_v$.

Referring again to FIG. 2, the inventive method may continue with the step 76 of controlling the current in coil 34 of the attracting electromagnet 18 responsive to the previously determined neutral position $x_v$ of the virtual spring. Referring to FIG. 1, ECU 50 may generate control signals to current delivery circuit 46 responsive to the determined neutral position $x_v$ to deliver current to coil 34 of electromagnet 18. Referring to FIG. 3, system 12 effectively modulates the current in coil 34. The characteristics of the control signal, however, will be determined internally by ECU 50 responsive to the amount of current required to move the virtual spring to the determined neutral position. As mentioned hereinabove, the virtual spring force corresponds to a combination of the magnetic force of the attracting electromagnet 18 and the restoring spring force of spring 24. Accordingly:

$$F_{spring,virtual} = F_{magnetic} + F_{spring,real}$$

or $$-k(x - x_v) = \frac{c_a i^2}{(x_L - x + c_b)^2} - k(x - x_o)$$

where k represents a spring constant associated with the restoring spring 24, x represents the current position of armature 20, $x_v$ represents the neutral position of the virtual spring, $x_L$ represents the landing position of the armature 20 (i.e., the position at which armature 20 engages pole face 38 of electromagnet 18), $x_o$ represents the neutral position of spring 24, and $c_a$ and $c_b$ are constants determined by the properties of actuator 10—typically from measurements of force relative to position. The constant $c_b$ will typically be positive and closed to zero. This equation may be solved by ECU 50 for the current i as follows:

$$i = \sqrt{\frac{k(x_v - x_o)(x_L - x + c_b)^2}{c_a}}$$

ECU 50 can then generate control signals in a conventional manner and provide them to circuit 46 to deliver the proper amount of current to coil 34.

Referring again to FIG. 2, the inventive method may continue by repeating steps 64, 76 a plurality of times until armature 20 has advanced beyond the desired position $x_d$. Once armature 20 has advanced beyond the desired position $x_d$, the inventive method may continue with the step 78 of controlling the current in coil 34 to maintain a constant predetermined current level as illustrated in FIG. 3. The predetermined current level is designed to maintain armature 20 in engagement with pole face 38 of electromagnet 18. As will be understood by those of skill in the art, a relatively low current level is required to maintain engagement of armature 20 and pole face 38 of electromagnet 18 once engaged because the magnetic force of attraction is inversely proportional to the square of the distance between armature 20 and electromagnet 18.

Figure 4:
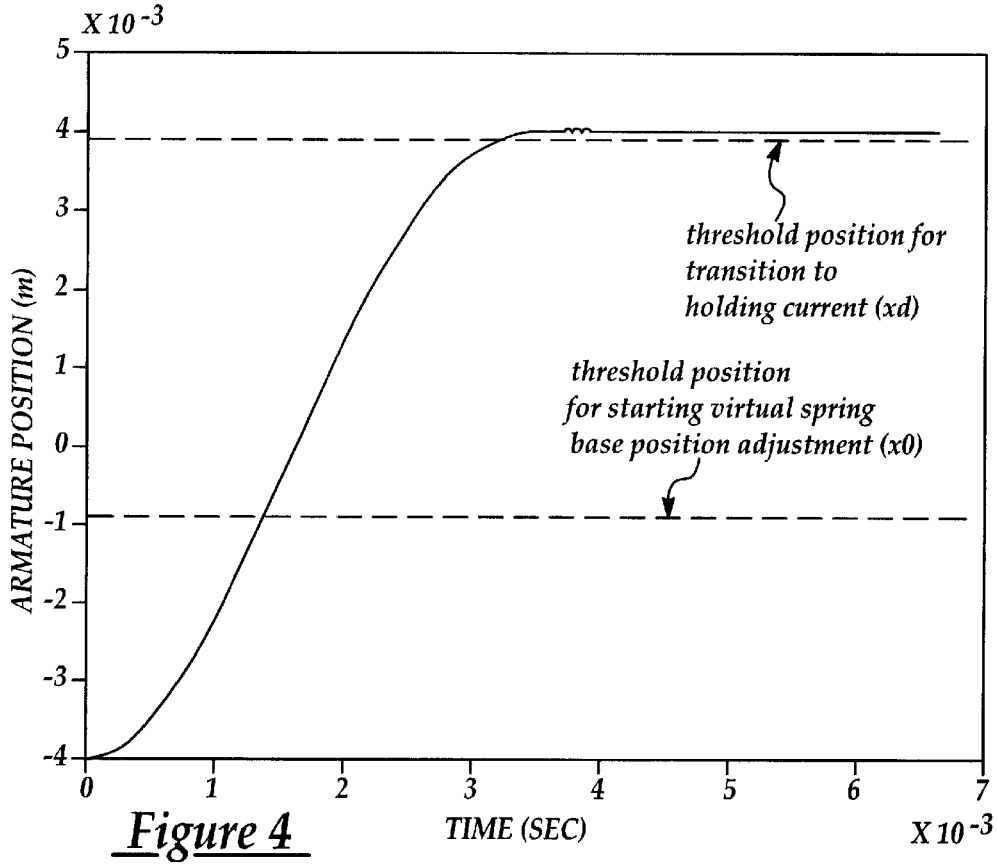
FIG. 4 is a graph illustrating the position of an armature of the actuator of FIG. 1 over time during movement of the armature towards the electromagnet in accordance with the inventive system and method.
Figure 5:
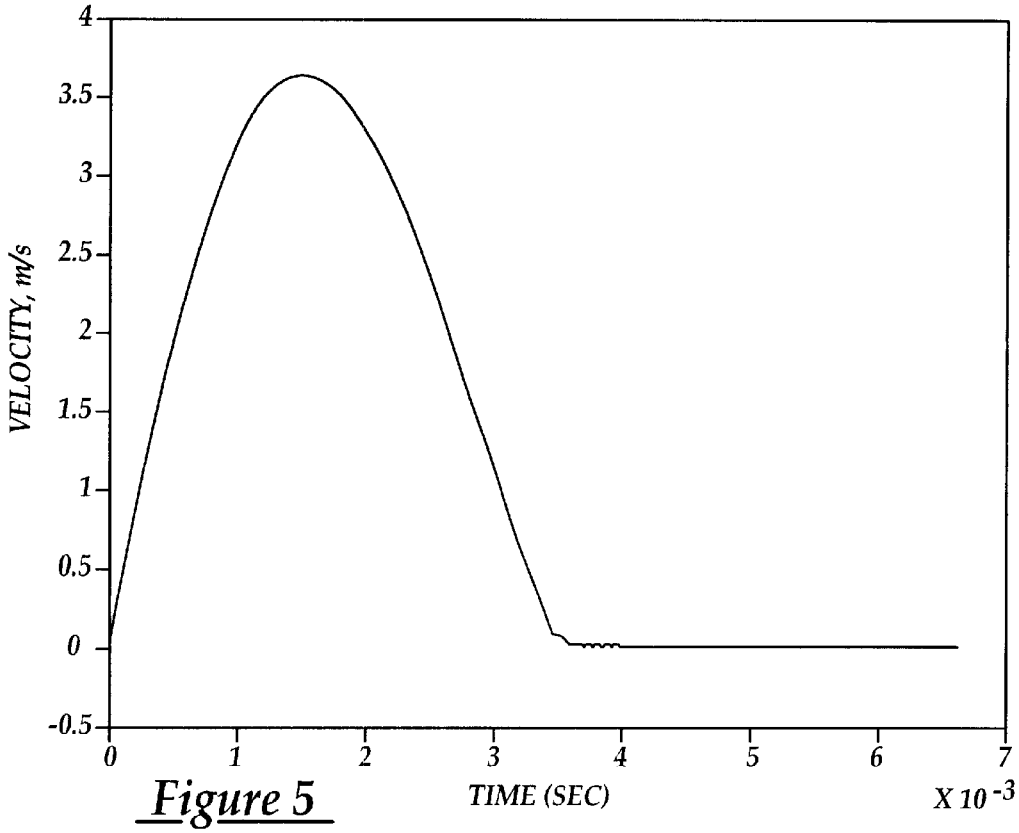
FIG. 5 is a graph illustrating the velocity of an armature of the actuator of FIG. 1 over time during movement of the armature towards the electromagnet in accordance with the inventive system and method.

A system and method in accordance with the present invention for controlling an armature in an electromagnetic actuator represent a significant improvement as compared to conventional systems and methods. The inventive system and method accurately and efficiently control the velocity of the armature as it approaches the pole face of the electromagnet thereby reducing the impact velocity of the armature as illustrated in FIGS. 4 and 5. As a result, wear on the mechanical components of the actuator is minimized and acoustic noise significantly reduced. Further, the inventive method and system are robust relative to unknown disturbance forces such as viscous damping that act on the armature as long as the disturbance forces are dissipating. Finally, the inventive method and system are not as complex as conventional methods and systems.

We claim:

1. A method for controlling movement of an armature towards a pole face of an electromagnet in an electromagnetic actuator, in which said armature moves toward said pole face against a force of a restoring spring when a coil of said electromagnet is charged with a current, said method comprising the steps of:

providing said current to said coil of said electromagnet;

determining a neutral position for a virtual spring after said armature reaches a predetermined position, said virtual spring having a virtual spring force corresponding to a combination of a magnetic force generated by said electromagnet responsive to said current and a restoring spring force generated by said restoring spring; and, controlling said current responsive to said neutral position of said virtual spring.

2. The method of claim 1, wherein said determining step includes the substeps of:

determining a position of said armature; and, comparing said position to said predetermined position.

3. The method of claim 1 wherein said determining step includes the substeps of:

determining a velocity of said armature; and, calculating said neutral position responsive to said velocity, a mass of said armature, a spring constant associated with said restoring spring, a desired position of said armature, and a predetermined threshold velocity of said armature at said desired position.

4. The method of claim 1 wherein said neutral position is restricted to a predetermined position range.

5. The method of claim 1 wherein said neutral position is determined responsive to a desired position of said armature and a predetermined threshold velocity of said armature at said desired position.

6. The method of claim 1 wherein said neutral position is determined in accordance with the following equation:

$$x_v(nT) = \left(\frac{m}{2k}\right) * \frac{v_{\max}^2 - v_a(nT)^2}{x_d - x(nT)} + \frac{x_d + x(nT)}{k}$$

wherein m represents a mass of said armature, k represents a spring constant associated with said restoring spring, x(nT) represents a position of said armature, $x_d$ represents a desired position of said armature, $v_{max}$ represents a predetermined threshold velocity of said armature at said desired position, and $v_a$(nT) represents a velocity of said armature.

7. The method of claim 1 wherein said controlling step includes the substep of determining said current in accordance with the following equation:

$$i = \sqrt{\frac{k(x_v - x_o)(x_L - x + c_b)^2}{c_a}}$$

wherein k represents a spring constant associated with said restoring spring, $x_v$ represents said neutral position of said virtual spring, $x_o$ represents a neutral position of said restoring spring, $X_L$ represents a landing position of said armature against said pole face, x represents a current position of said armature, and $c_a$, $c_b$ are constants.

8. The method of claim 1, further comprising the step of repeating said determining and said controlling steps until said armature reaches a desired position.

9. The method of claim 1 wherein said electromagnetic actuator is used to control a fuel injector in an internal combustion engine.

10. The method of claim 1 wherein said electromagnetic actuator is used to control one of an intake valve and an exhaust valve in an internal combustion engine.

11. A system for controlling movement of an armature towards a pole face of an electromagnet in an electromagnetic actuator, in which said armature moves toward said pole face against a force of a restoring spring when a coil of said electromagnet is charged with a current, said system comprising:

means for providing said current to said coil of said electromagnet; and, an electronic control unit configured to determine a neutral position for a virtual spring after said armature reaches a predetermined position and to control said current responsive to said neutral position of said virtual spring, said virtual spring having a virtual spring force corresponding to a combination of a magnetic force generated by said electromagnet responsive to said current and a restoring spring force generated by said restoring spring.

12. The system of claim 11, further comprising an armature position sensor, wherein said electronic control unit is further configured, in determining said neutral position, to compare a position of said armature to said predetermined position.

13. The system of claim 11, wherein said electronic control unit is further configured, in determining said neutral position, to calculate said neutral position responsive to a velocity of said armature, a mass of said armature, a spring constant associated with said restoring spring, a desired position of said armature, and a predetermined threshold velocity of said armature at said desired position.

14. The system of claim 11 wherein said neutral position is restricted to a predetermined position range.

15. The system of claim 11 wherein electronic control unit determines said neutral position responsive to a desired position of said armature and a predetermined threshold velocity of said armature at said desired position.

16. The system of claim 11 wherein said electronic control unit is configured to determine said neutral position in accordance with the following equation:

$$x_v(nT) = \left(\frac{m}{2k}\right) * \frac{v_{\max}^2 - v_a(nT)^2}{x_d - x(nT)} + \frac{x_d + x(nT)}{k}$$

wherein m represents a mass of said armature, k represents a spring constant associated with said restoring spring, x(nT) represents a position of said armature, $x_d$ represents a desired position of said armature, $v_{max}$ represents a predetermined threshold velocity of said armature at said desired position, and $v_a$(nT) represents a velocity of said armature.

17. The system of claim 11 wherein said electronic control unit is further configured, in controlling said current, to determine said current in accordance with the following equation:

$$i = \sqrt{\frac{k(x_v - x_o)(x_L - x + c_b)^2}{c_a}}$$

wherein k represents a spring constant associated with said restoring spring, $x_v$ represents said neutral position of said virtual spring, $x_o$ represents a neutral position of said restoring spring, $x_L$ represents a landing position of said armature against said pole face, x represents a current position of said armature, and $c_a$, $c_b$ are constants.

18. The system of claim 11 wherein said electronic control unit is further configured to repeatedly determine said neutral position of said virtual spring and control said current responsive to said neutral position until said armature reaches a desired position.

19. The system of claim 11 wherein said electromagnetic actuator is used to control a fuel injector in an internal combustion engine.

20. The system of claim 11 wherein said electromagnetic actuator is used to control one of an intake valve and an exhaust valve in an internal combustion engine.

21. An article of manufacture, comprising:

a computer storage medium having a computer program encoded therein for controlling movement of an armature towards a pole face of an electromagnet in an electromagnetic actuator, in which said armature moves toward said pole face against a force of a restoring spring when a coil of said electromagnet is charged with a current, said computer program including:

code for determining a neutral position for a virtual spring after said armature reaches a predetermined position, said virtual spring having a virtual spring force corresponding to a combination of a magnetic force generated by said electromagnet responsive to said current and a restoring spring force generated by said restoring spring; and, code for controlling said current responsive to said neutral position of said virtual spring.

22. The article of manufacture of claim 21 wherein said code for determining a neutral position of said virtual spring includes code for comparing a position of said armature to a predetermined position.

23. The article of manufacture of claim 21 wherein said code for determining a neutral position of said virtual spring includes code for calculating said neutral position responsive to a velocity of said armature, a mass of said armature, a spring constant associated with said restoring spring, a desired position of said armature, and a predetermined threshold velocity of said armature at said desired position.

24. The article of manufacture of claim 21 wherein said code for determining a neutral position of said virtual spring includes code for restricting said neutral position to a predetermined position range.

25. The article of manufacture of claim 21 wherein said code for determining a neutral position of said virtual spring includes code for calculating said neutral position responsive to a desired position of said armature and a predetermined threshold velocity of said armature at said desired position.

26. The article of manufacture of claim 21 wherein said code for determining a neutral position of said virtual spring includes code for determining said neutral position in accordance with the following equation:

$$x_v(nT) = \left(\frac{m}{2k}\right) * \frac{v_{\max}^2 - v_a(nT)^2}{x_d - x(nT)} + \frac{x_d + x(nT)}{k}$$

wherein m represents a mass of said armature, k represents a spring constant associated with said restoring spring, x(nT) represents a position of said armature, $x_d$ represents a desired position of said armature, $v_{max}$ represents a predetermined threshold velocity of said armature at said desired position, and $v_a$(nT) represents a velocity of said armature.

27. The article of manufacture of claim 21 wherein said code for controlling said current includes code for determining said current in accordance with the following equation:

$$i = \sqrt{\frac{k(x_v - x_o)(x_L - x + c_b)^2}{c_a}}$$

wherein k represents a spring constant associated with said restoring spring, $x_v$ represents said neutral position of said virtual spring, $x_o$ represents a neutral position of said restoring spring, $x_L$ represents a landing position of said armature against said pole face, x represents a current position of said armature, and $c_a$, $c_b$ are constants.

28. The article of manufacture of claim 21 wherein said computer program further includes code for repeating said code for determining a neutral position of said virtual spring and said code for controlling said current responsive to said neutral position until said armature reaches a desired position.

* * * * *